US005485961A

United States Patent [19]

Reitzig

[11] Patent Number: 5,485,961

[45] Date of Patent: Jan. 23, 1996

[54] NOZZLE HEAD FOR A JET CLEANING DEVICE

[75] Inventor: Klaus Reitzig, Issum, Germany

[73] Assignee: WOMA Apparatebau GmbH, Duisburg, Germany

[21] Appl. No.: 303,194

[22] Filed: Sep. 8, 1994

[51] Int. Cl.[6] ..... B05B 3/02; B05B 1/14

[52] U.S. Cl. ..... 239/558; 239/246

[58] Field of Search ..... 239/591, 548, 239/558, 263.1, 246, 249; 134/198, 122 R, 164

[56] References Cited

U.S. PATENT DOCUMENTS

| | | | |
|---|---|---|---|
| 2,518,543 | 8/1950 | Haase | 239/558 X |
| 2,901,184 | 8/1959 | Kane | 134/198 X |
| 3,447,966 | 6/1969 | Manno | 134/198 X |
| 5,402,936 | 4/1995 | Hammelmann | 239/263.1 |

*Primary Examiner*—Kevin P. Weldon

*Attorney, Agent, or Firm*—McAulay Fisher Nissen Goldberg & Kiel

[57] ABSTRACT

The invention relates to a nozzle head for a jet cleaning device, the nozzle head having a central axis and a front face, being provided with a central bore aligned with the central axis and further with a multitude of straight supply bores which pass with their axes in an acute angle to the central axis from the central bore to the front face, and the supply bores ending at the front face in receiving holes. One nozzle is inserted into each receiving hole and each nozzle is provided with a bore having a reduced diameter and ending at the front face such that pressurized fluid supplied via the supply bores is emerging jet-like from the front face. The receiving holes and thus the nozzle bore exits are arranged in a regular angular spacing and on different circles around the central axis.

11 Claims, 1 Drawing Sheet

NOZZLE HEAD FOR A JET CLEANING DEVICE

BACKGROUND OF THE INVENTION

This invention relates to a nozzle head for a jet cleaning device. Jet cleaning devices are used for cleaning surfaces from material which adheres strongly to surfaces. For example, the jet cleaning device may be used for cleaning metal or concrete surfaces as the outer surfaces of ship bodies from adherent material as mussels or for removing varnish or other coatings from the outer surfaces of busses, aeroplanes, walls, streets or the like.

In general, such a cleaning device comprises a high pressure pump for supplying fluid under a high pressure to a jet producing device for applying a jet to the surface to be cleaned while guiding the jet along this surface. The jet producing device may be of a pistol type for controlling the fluid supply and maybe provided with a lance tube at the front end of. The nozzle head in turn, a nozzle head is provided, which contains several nozzles for directing jets of pressurized fluid, in general water, onto the surface to be cleaned. During the cleaning, the nozzle head rotates so that a corresponding surface area is cleaned at the same time. The nozzle head is rotated by a drive assembly.

The nozzles are arranged circularly with an equal angular distance. Therefore, the jets emerging from the nozzles impinge in one circle onto the surface to be cleaned. On one hand, this may erode the surface to be cleaned if the nozzle head is directed for a longer time onto the same area, and, on the other hand, the speed of moving the nozzle head along said surface is relatively low, since the whole surface has to be wiped by the jets.

SUMMARY OF THE INVENTION

It is an object of the invention to provide a nozzle head for a jet cleaning device having an improved cleaning efficiency.

It is a further object of the invention to provide a nozzle head for a jet cleaning device avoiding the impingement of all jets onto the same circle area of the surface to be cleaned if the nozzle head is not or very slowly moved with respect to the surface to be cleaned.

Briefly, the invention provides a nozzle head having a body with a central bore disposed in the body on a central axis thereof for receiving a pressurized flow of fluid. In addition, a plurality of supply bores are disposed in the body in communication with the central bore to receive pressurized fluid therefrom. These supply bores are circumferentially disposed about the central bore and are straight with the axes of the bores at an acute angle relative to the central axis of the body. Each of the supply bores also extend to a front face of the nozzle body.

The nozzle head also has a plurality of nozzles mounted in the front face of the body circumferentially of the central axis. Each such nozzle communicates with a respective supply bore to receive pressurized fluid therefrom and has a bore of reduced diameter for expelling a jet of fluid therefrom. At least one bore of the respective nozzle is radially spaced from the central axis a distance from others of said bores.

Each nozzle of a pair of oppositely disposed nozzles is equi-distance from the central axis. In addition, each nozzle of a pair of oppositely disposed nozzles is at a different radial spacing from the central axis than an adjacent nozzle. For example, the nozzles each half of the front face of the nozzle head are on different circles of decreasing diameters around the central axis.

In one embodiment, each nozzle bore is coaxial of a respective supply bore. In another embodiment, each nozzle bore is angularly disposed relative to a respective supply bore.

The axes of the receiving holes may be aligned with the axes of the corresponding one of the supply bores or the receiving holes may be arranged on one circle around the central axis, wherein at least some of the axes of the receiving holes are inclined by an acute angle with respect to the axes of the corresponding supply bores such that the bores of the nozzles are provided on different circles around the central axis.

By this it is possible to enhance the efficiency of cleaning because by one rotation of the nozzle head an enlarged area is wiped since the nozzle exits are arranged on different circles around the central axis of the nozzle head so that the speed of cleaning is increased. Furthermore, not all of the jets emerging from the nozzle head impinge on the same circle area if the nozzle head is not or very slowly moved with respect to the surface to be cleaned.

DETAILED DESCRIPTION OF THE DRAWINGS

DESCRIPTION OF THE EMBODIMENTS

Figure 1:
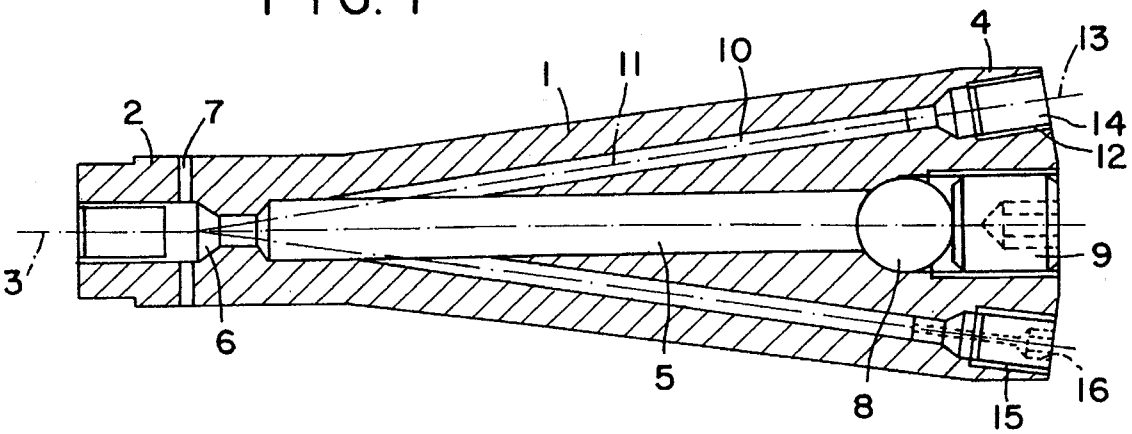
FIG. 1 is a sectional view of an embodiment of a nozzle head according to the invention.

According to FIG. 1, the shown nozzle head has a body in the form of an elongated truncated cone portion 1 which at its rear end is provided with a cylindrical connecting portion 2 for connecting the nozzle head to a lance tube (not shown) of a jet cleaning device. At the front end the truncated cone portion 1 of the nozzle head having a central axis 3 ends in a cylindrical portion 4.

The nozzle head is provided with a central bore 5. The rear part of the central bore 5 within the cylindrical connecting portion 2 is internally threaded so that the nozzle head may be screwed onto the forward end of a lance tube. Adjacent to the threaded portion of the central bore 5, a seat 6 for the forward end of the lance tube is provided within the central bore 5, For draining purposes, bores 7 of small diameter may be provided in this area.

The central bore 5 ends at the front face of the nozzle head and is provided with an enlarged diameter adjacent to the front face. The portion of enlarged diameter is provided with a thread and defines a seat for a ball 8 which is pressed against this seat by a screw 9 inserted from the side of the front face.

The nozzle head is further provided with a multitude of straight supply bores 10 (in the illustrated embodiment eight bores 10) which pass with their axes 11 and an acute angle to the central axis 3 from the central bore 5 to the front face of the nozzle head.

The supply bores 10 end adjacent to the front face in receiving holes 12, the axes 13 of which being aligned with the axes 11 of the supply bores 10. A nozzle 14 is inserted into each receiving hole 12. Each nozzle 14 is provided with a bore 15 of reduced diameter such that pressurized fluid supplied from a lance tube via the central bore 3 to the supply bores 10 emerges in jet-like manner.

Figure 2:
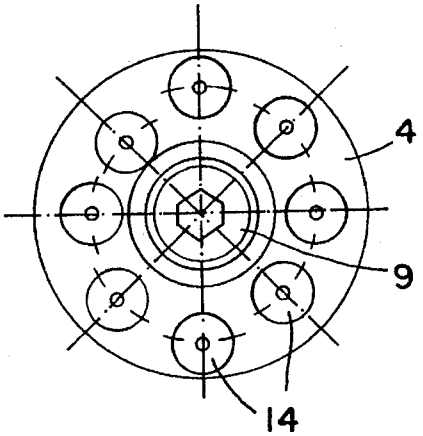
FIG. 2 shows a front view of the nozzle head of FIG. 1.

The receiving holes 12 are arranged in a regular angular spacing of equal angular distance and on different circles around the central axis, see FIG. 2. Each pair of diametrically opposed nozzles 14 are provided on the same circle around the central axis 3 and such that the nozzles 14 in each of the two halfs of the front face are on different circles of decreasing diameter around the central axis 3. Thus, the nozzles 14 may be arranged on one or two spiral portions extending over 360° and 180°, respectively.

The acute angle between the axes 13 of the supply bores 10 and the central axis 3 is preferably less than 10°.

Figure 3:
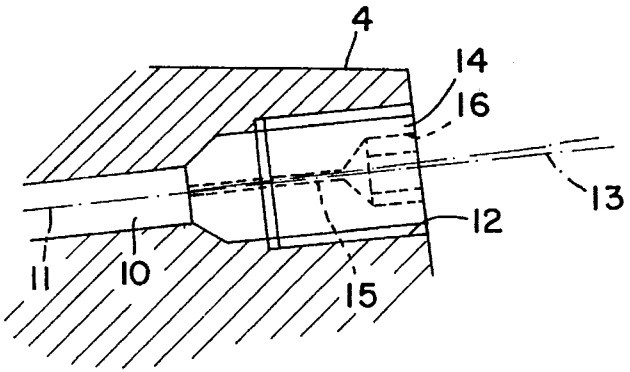
FIG. 3 shows a detail of FIG. 1 in enlarged scale of a modified embodiment.

According to FIG. 3, the same arrangement of the nozzle bores 15 is obtained when the receiving holes 12 are arranged in a regular angular spacing on one circle around the central axis 3, while some of the axes 13 of the receiving holes 12, for instance the axes of the receiving holes 12 on the outer and inner circles of FIG. 2, are inclined by a corresponding acute angle with respect to the axes 13 of the corresponding supply bores 10 such that the nozzles 14 with their nozzle bores 15 are provided on different circles around the central axis 3, as it is shown for instance in FIG. 2.

At the front faces of the nozzles 14, a hexagonal recess 16 may be provided for the insertion of a corresponding tool for mounting and demounting the nozzles 14.

It will thus be seen that the objects set forth above, among those made apparent from the proceeding description, are efficiently attained and, since certain changes may be made in carrying out the construction set forth without departing from the spirit and scope of the invention, it is intended that all matter contained in the above description and shown in the accompanying drawings shall be interpreted as illustrative and not in a limiting sense.

I claim:

1. A nozzle head having a central axis and a front face and being provided with a central bore aligned with said central axis, said nozzle head further being provided with a multitude of straight supply bores which pass with their axes in an acute angle to said central axis from said central bore to said front face, said supply bores ending at said front face in receiving holes, one nozzle being inserted into each receiving hole, each nozzle being provided with a bore having a reduced diameter and ending at said front face such that pressurized fluid supplied via said supply bores is emerging jet-like from said front face, and said receiving holes together with their inserted nozzles being arranged in a regular angular spacing and on different circles around said central axis.

2. The nozzle head according to claim 1, wherein the axes of said receiving holes are aligned with the axes of the corresponding one of said supply bores.

3. The nozzle head according to claim 1, wherein each pair of diametrically opposed nozzles are on the same circle around the central axis.

4. The nozzle head according to claim 1, wherein the nozzles in each half of the front face are on different circles of decreasing diameters around the central axis.

5. The nozzle head according to claim 1, wherein said acute angle between the axes of said supply bores and the central axis is less than 10°.

6. The nozzle head according to claim 1, wherein adjacent to said front face said central bore of said nozzle carrier is provided with a threaded portion having an enlarged diameter and defining a seat for a ball, said ball being pressed against its seat by a screw inserted from said front face.

7. A nozzle head comprising a body;

a central bore disposed in said body on a central axis thereof for receiving a pressurized flow of fluid;

a plurality of supply bores communicating with said central bore to receive pressurized fluid therefrom, said supply bores being circumferentially disposed about said central bore;

a plurality of nozzles mounted in a front face of said body circumferentially of said central axis, each said nozzle communicating with a respective supply bore to receive pressurized fluid therefrom and having a bore for expelling a jet of fluid therefrom, at least one bore of a respective nozzle being radially spaced from said central axis a distance different from others of said nozzle bores and each nozzle bore being coaxial of a respective supply bore.

8. A nozzle head as set forth of claim 7 wherein each nozzle of a pair of oppositely disposed nozzles is equidistant from said central axis.

9. A nozzle head as set forth of claim 7 wherein each nozzle for pair of oppositely disposed nozzles is at a different radial spacing from said central axis than an adjacent nozzle.

10. A nozzle head as set forth of claim 7 wherein said nozzles are equispaced angularly of said central axis.

11. A nozzle head having a central axis and a front face and being provided with a central bore aligned with said central axis;

said nozzle head further being provided with a multitude of straight supply bores which pass with their axes in an acute angle to said central axis from said central bore to said front face;

said supply bores ending at said front face in receiving holes;

one nozzle being inserted into each receiving hole;

each nozzle being provided with a bore having a reduced diameter and ending at said front face such that pressurized fluid supplied via said supply bores is emerging jet-like from said front face;

said receiving holes together with their inserted nozzles being arranged in a regular angular spacing and on a circle around said central axis; and wherein at least some of the axes of said receiving holes are inclined by an acute angle with respect to the axes of the supply bores such that said bores of said nozzles are provided on different circles around said central axis.

* * * * *

UNITED STATES PATENT AND TRADEMARK OFFICE

CERTIFICATE OF CORRECTION

PATENT NO. : 5,485,961

DATED : Jan. 23, 1996

INVENTOR(S) : Klaus Reitzig

It is certified that error appears in the above-indentified patent and that said Letters Patent is hereby corrected as shown below:

Column 1, line 19 change "maybe" to —may be--

Column 1, line 20, change "The nozzle head in turn" to --which--

Line 21, change ", which" to -- . The nozzle head, in turn, --

Signed and Sealed this

Sixteenth Day of April, 1996

Bruce Lehman

BRUCE LEHMAN

*Commissioner of Patents and Trademarks*

*Attest:*

*Attesting Officer*